US007072567B2

(12) United States Patent
Hammers

(10) Patent No.: US 7,072,567 B2
(45) Date of Patent: Jul. 4, 2006

(54) METAL FABRIC AND METHOD FOR MANUFACTURING A METAL FABRIC

(75) Inventor: Michael Hammers, Aachen (DE)

(73) Assignee: GKD - Gebr. Kufferath AG, Düren (DE)

( * ) Notice: Subject to any disclaimer, the term of this patent is extended or adjusted under 35 U.S.C. 154(b) by 41 days.

(21) Appl. No.: 10/868,444

(22) Filed: Jun. 10, 2004

(65) Prior Publication Data

US 2005/0002636 A1 Jan. 6, 2005

(30) Foreign Application Priority Data

Jun. 11, 2003 (DE) ..... 103 26 655
Sep. 18, 2003 (DE) ..... 103 43 664

(51) Int. Cl.
*G02B 6/00* (2006.01)

(52) U.S. Cl. ..... 385/147; 385/120; 362/556

(58) Field of Classification Search ..... 385/115–120, 385/147; 362/556; 451/41
See application file for complete search history.

(56) References Cited

U.S. PATENT DOCUMENTS 4,234,907 A * 11/1980 Daniel ..... 362/556

FOREIGN PATENT DOCUMENTS

| | | |
|---|---|---|
| DE | 3 44 697 C | 11/1921 |
| DE | 100 12 614 A1 | 9/2001 |
| DE | 101 27 299 A1 | 12/2002 |
| WO | 87/00 012 A1 | 1/1987 |

* cited by examiner

*Primary Examiner*—Phan Palmer
(74) *Attorney, Agent, or Firm*—Collard & Roe, P.C.

(57) ABSTRACT

In order to provide a metal fabric of a design which reduces or even completely compensates for the effect of darkening which is intrinsic to the metal fabric at a predetermined fabric density, a metal fabric having an optical waveguide element penetrating a core fabric area is suggested. In addition, a metal fabric having multiple optical waveguide elements and/or optical waveguide elements integrated structurally into the fabric is suggested. In addition, a method for manufacturing a metal fabric is presented.

15 Claims, 2 Drawing Sheets

METAL FABRIC AND METHOD FOR MANUFACTURING A METAL FABRIC

Figure 1:
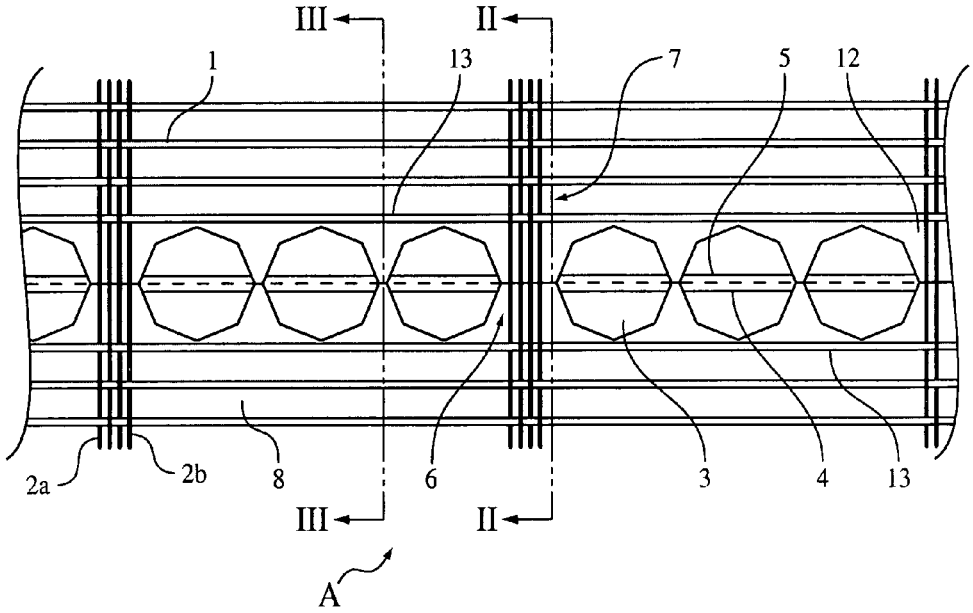

The present invention relates to a metal fabric and a method for manufacturing a metal fabric.

Metal fabrics are used for manifold tasks. Among other things, they are used on buildings, for example, as facade hangings, as a room divider, and/or as the immediate outer skin of the building.

In most cases, a relatively dense metal fabric is necessary or desirable for aesthetic reasons. For example, a relatively high density of the fabric may be necessary if the fabric is integrated in the static structure and therefore must support loads. Such fabrics are also usable as permanent burglar-proof devices in front of windows, even on private houses.

However, this use has the disadvantage that a dense metal fabric is relatively opaque to light. As a consequence, precisely when the fabric is used as a facade hanging, window hanging, outer skin, or room divider, there is automatically shadowing of one side of the metal fabric, which is often undesirable.

The present invention is based on the object of providing a metal fabric of this type which, at a predetermined fabric density, reduces or even completely compensates for the effect of darkening inherent to the metal fabric.

This object is achieved by a metal fabric having an optical waveguide element which penetrates a core fabric area defined by the warp and weft threads of the metal fabric. For example, the core fabric area may be a plane.

An active light connection is produced between the two sides of the fabric area by the positioning of the optical waveguide element. In this way, light is captured on one side and at least partially conducted to the other side and may be emitted there in a targeted or untargeted way. The darkening effect caused by the shadowing as a result of light absorption of the metal fabric elements may thus be at least reduced and, if the optical waveguide element is positioned especially suitably, particularly if there are multiple optical waveguide elements and/or especially suitable illumination of one side of the fabric, may even be almost completely compensated for by the bundled light transmission.

In this case, the mathematical area having a thickness of zero which may be imagined centrally in the fabric is understood above all as the core fabric area. Typically, metal fabrics according to the species are pronouncedly two-dimensional and have only a relatively low thickness.

In a preferred embodiment, the metal fabric has a light coupling region and a light decoupling region on its optical waveguide element, at least one of the coupling regions projecting outward out of the core fabric area. Any region on the surface of the optical waveguide element at which light from outside the optical waveguide element may penetrate into the body is understood as a light coupling region. Analogously, any region of the surface at which light which is conducted inside the body may leave the body with refraction or linearly is understood as a light decoupling region.

Because at least one of the coupling regions projects outward out of the core fabric area, an especially large-angle free opening exists between the surrounding weft and/or warp threads of the fabric. In particular, the coupling region may even project out of the surface of the metal fabric, through which, with a suitable design of the coupling region, this region may have a direct visual connection to at least a semi-spherical spatial region without the weft and/or warp threads blocking the view, i.e., any possible light connection.

Therefore, even in the event of a large angle of incidence of the light, the light may be captured and transmitted bundled to the other side.

In order to ensure especially good light conduction between the two sides of the metal fabric, it is suggested that both coupling regions project out of the core fabric area on diametrically opposing sides. In this case, an especially large-angle active space is available for both the light coupling and the light decoupling. As soon as the coupling regions even project over the fabric surface, with a suitable design, light from one entire spatial side of the metal fabric may be transmitted to the entire other spatial side of the metal fabric. In the final analysis, this is only still a function of the optical waveguide paths inside the optical waveguide element.

It is to be noted that a metal fabric having an optical waveguide element with coupling regions in which both coupling regions project out of the core fabric area on diametrically opposing sides is also advantageous and inventive per se.

Alternatively or cumulatively to this, it is advantageous if at least one coupling region has a coupling area angularly offset to the fabric surface. The angularly offset coupling area may make up the entire coupling region of this side of the optical waveguide element. However, it is preferable if one coupling region has multiple coupling areas. These may even be positioned at different angles to the fabric surface. In this way, an especially uniform or at least multifaceted light coupling and/or light decoupling results.

If the coupling region has multiple coupling areas, these may advantageously adjoin one another directly at least partially. In such a case, dead regions do not necessarily lie between two coupling areas of a coupling region. Therefore, all of the light which is incident between the outer borders of the two neighboring coupling areas is also coupled and/or decoupled. Leakage radiation and light absorption on the optical waveguide element are thus minimized.

For especially effective light connection, the coupling regions may have coupling and decoupling areas, which communicate with one another in pairs, with an essentially equal angle to the fabric plane in pairs. With such an arrangement, the coupling areas communicating with one another may be approximately parallel, so that light which is coupled into the optical waveguide element via the coupling area is decoupled again at the decoupling area approximately parallel to its original beam direction, if no further refractions or reflections occur inside the optical waveguide element. Precisely if there are multiple coupling and decoupling areas communicating with one another in pairs on an optical waveguide element, it may therefore be ensured that light which is incident on the metal fabric in the region of the optical waveguide element penetrates through the body approximately as if there were no obstruction in the beam path. The natural direction of incident light may be maintained in this way. An offset in the beam path merely occurs inside the optical waveguide element, the offset offsetting the light beam by approximately the thickness of the fabric to the other side.

It is to be emphasized that a fabric made of light-opaque materials with optical waveguides having coupling and decoupling areas communicating with one another in pairs and an essentially equal angle to the fabric plane in pairs is also advantageous and inventive considered per se and independently of the remaining features of the present invention.

Independently of the concrete embodiment of the optical waveguide element, it is suggested that the optical waveguide element be constructed and/or situated at least essentially symmetrically in relation to the fabric plane. In this way, the orientation of the fabric becomes largely irrelevant, i.e., there is not one side which must be used for coupling the light and one side which must be used for decoupling the light. Rather, the fabric may be installed arbitrarily. For example, an essentially axially symmetric optical waveguide element may be positioned with its axis of symmetry in the fabric surface, so that approximately equally large parts of the optical waveguide element project out on both sides of the fabric.

In order that the fabric has an optically neutral effect without incident light, but looks colored in the event of special incident light, it is suggested that the optical waveguide element be colorless but prismatic.

It is obvious that even one optical waveguide element of the type suggested in a metal fabric provides the advantages cited. However, a metal fabric having multiple optical waveguide elements of the type described, which are preferably positioned regularly in relation to one another in the fabric, is particularly assumed. This improves not only the conductivity, but rather also the visual effect of the fabric, with or without incident light.

Crystal structures are especially suitable for capturing, conducting, and emitting the light. These may be colored, but are particularly also made of colorless plastic or glass, which allows cost-effective manufacture, among other things.

Precisely if they are used on facades, fabrics according to the species are often installed at great heights. In this regard, a great danger exists, both for the optical waveguide element and for any objects or persons located under the fabric, that the optical waveguide elements may detach and fall down.

Depending on their attractiveness, such optical waveguide elements may also be subject to the danger of being stolen by passersby. Thus, a conglomeration made of metal fabric and artificial crystals exists in a shared exhibition of the three companies GKD AG, Düren, Nagel-Hammers, Wesseling, both German, and D. Swarovski & Co., Wattens, Austria. In this case, the artificial crystals are attached on one side of the metal fabric to the weft rods using small clamps. In this way, an optical effect is generated in which observers are presented with light from 124 halogen emitters, each of 20 watts, resolved into spectral colors. The halogen emitters are changed over time by computer control; however, the observer is on the same side of the fabric as the light sources, since only the reflection properties of the metal fabric are used in connection with the reflection properties of the crystals. A very strong darkening may be seen on the rear of the crystal-metal fabric conglomeration in the exhibition.

Such a fabric may obviously not be used as a facade hanging or room divider in public areas, since these crystals may be stolen very easily. In order to provide a combination of metal fabric and optical waveguide elements, particularly crystals, but nonetheless have a broad usage possibility with sufficient security, it is suggested independently of the above-mentioned features that optical waveguide elements, particularly crystals, be structurally integrated in a metal fabric. In particular, the crystals may be threaded onto a wire or another carrier and may be connected at multiple points to the weft or particularly the warp of the metal fabric. For this purpose, bending the carrier wire of the crystals or a clamp which connects the carrier wire to the metal fabric suggests itself. In particular, the optical waveguide element may be connected to a carrier thread and/or carrier wire and this may be integrated into the fabric.

Such a fabric is then especially secured, from theft above all, if separating the optical waveguide element from the carrier requires detaching the carrier from the fabric.

Independently of this, it is suggested that the carrier wire be laid, essentially perpendicular to the warp threads, as deep as possible in the fabric surface and attached there, particularly to intersections of grouped warp threads running in the opposite direction.

In order to be able to integrate the largest possible optical waveguide elements into the fabric and simultaneously provide the light with an enlarged radiation area, it is also suggested that the optical waveguide elements be integrated into the fabric where weft rods had previously been removed from the homogeneous metal fabric. Through the attachment of the optical waveguide elements to the warp threads, structural weakening of the fabric caused by removal of weft rods is reduced. This is particularly important in large metal fabrics which are installed hanging. The installation of such a metal fabric is performed under large tensile stresses because of its high intrinsic weight. By attaching the optical waveguide elements to warp threads where weft rods had been removed, neighboring weft rods left in the fabric may be effectively prevented from leaving their stable position, particularly if an odd number of warp rods were removed, and instead slipping between the warp thread plane.

In addition, points of increased flexibility in the fabric are provided through the removal of the weft rods and the attachment of the optical waveguide elements there. The rollability of the fabric is thus increased.

In addition, a combined metal-optical waveguide element fabric may be manufactured at the factory and transported in this form to the installation location. Larger areas, for example, coherent fabrics of the magnitude of entire facades, may also be stacked without problems in this case.

The present invention opens new fields of use for metal fabrics. In particular, inscriptions, company identifications, or similar things may be integrated permanently and securely attached in a metal fabric. In addition, the fabric may also be used where light conduction properties are explicitly needed, for example, in lampshades.

The present invention will be explained for exemplary purposes in the drawing on the basis of exemplary embodiments. In this case, identical identification numbers in different figures of the drawing may identify identical components.

Figure 2:
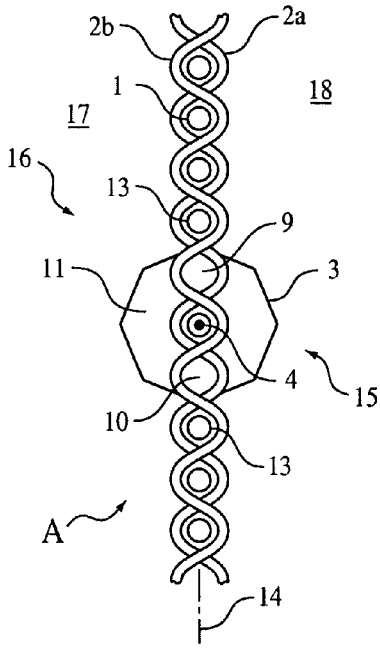
Figure 3:
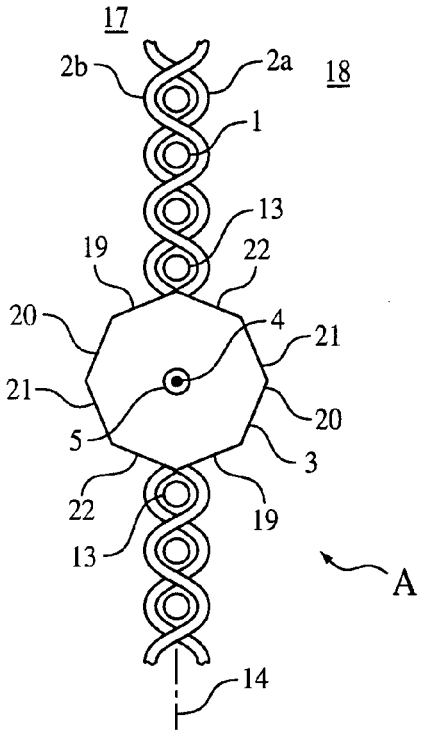
Figure 4:
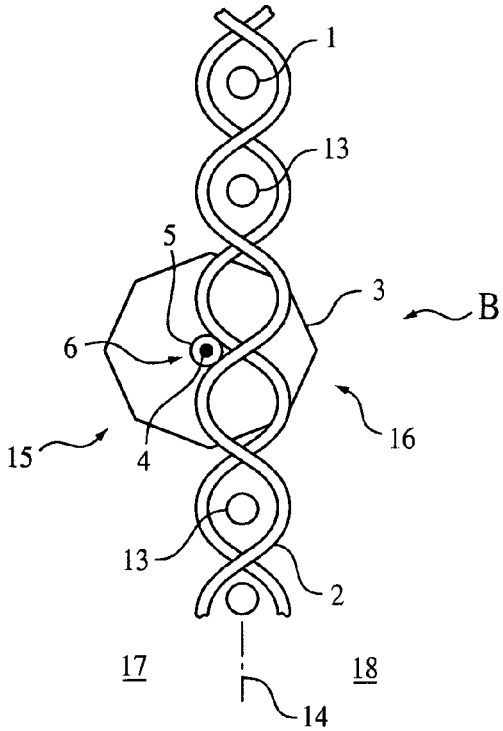

FIG. 1 shows a schematic top view of a first metal fabric having crystals threaded on a carrier wire, FIG. 2 shows the fabric from FIG. 1 in a schematic cross-section along the line II—II, FIG. 3 shows the fabric from FIGS. 1 and 2 in a cross-section on the line III—III, and FIG. 4 shows an alternative metal fabric having crystals on a clamped-on carrier wire.

The metal fabric A in FIGS. 1 through 3 primarily includes weft wires 1 and warp wires 2*a*, 2*b*, which are woven together in a known way. In addition, however, glass crystals 3 are integrated into the fabric A. For this purpose, each of the glass crystals 3 is provided with a threading channel 5 and threaded serially on a carrier wire 4. Three glass crystals 3 at a time are assembled as a group between structural connection points 6 on warp groups 7 in this case.

Since the glass crystals 3 are larger than the free spaces 8 between two weft wires 1, neighboring weft wires 1 are removed from the fabric A at flaws 9, 10, 11, so that a resulting gap space 12 precisely accommodates the glass crystals 3. If the glass crystals 3 are threaded centrally, the removal of an odd number of weft wires 1 allows the crystals to be provided with an equal interval to the neighboring weft wires 13. However, for this purpose it must be accepted that an open connection results between the warp wires 2*a*, 2*b* (most clearly visible in FIG. 2) between the edge weft wires 13 before the attachment of the carrier wires 4.

In the fabric A, the carrier wire 4 is integrated into the fabric in such a way that it assumes the course 11 of a removed weft wire. In this way, it stabilizes the warp wires 2*a*, 2*b* and its height is simultaneously fixed. Such an integration into the fabric is structurally optimal and simultaneously allows an absolutely symmetrical arrangement of the glass crystals 3 in relation to a fabric plane 14.

However, it has the disadvantage that the glass crystals 3 must be conveyed to their target position before they are threaded on for this purpose. High precision is also necessary, so that the carrier wire 4 may pass through the threading channels 5 cleanly during threading.

Because of the symmetrical arrangement of the glass crystals 3 in the fabric A, two coupling regions 15, 16 project equally out of two sides 17, 18 of the fabric A. The cross-section shows four light coupling and/or decoupling areas 19, 20, 21, 22, communicating with one another in pairs, each pair of which has an equal-opposing-angle in relation to the fabric plane 14.

In the metal fabric B in FIG. 4, glass crystals 3 are inserted into a free space in the metal fabric B by removing two weft wires 1. Since an even number of weft wires is removed, the neighboring weft wires 13 are on different sides 17, 18 of the warp wire 2. There is thus only a slight danger that the weft wires 1 may slip along the fabric plane 14 between the warp wires 2. Rather, they would wedge between the warp wires 2.

In consideration of this high intrinsic strength of the fabric B and in order to be able to integrate the glass crystals 3, which are provided threaded on a carrier wire 4, more easily into the fabric B, the carrier wires 4 are laid in structural connection points 6 lying deep in the fabric B and connected there to the warp wires 2 from one side of the fabric B after the fabric B is woven. Depending on the field of application and material dimensioning, this may be advantageous because the assembly of the metal fabric and the threaded glass crystals may proceed significantly more cost-effectively and rapidly.

The invention claimed is:

1. A metal fabric, wherein an optical waveguide element penetrates a core fabric area, said optical waveguide element having a light coupling region and a light decoupling region, at least one of the coupling regions projecting outward out of the core fabric area.

2. The metal fabric according to claim 1 having multiple optical waveguide elements positioned regularly in relation to one another in the fabric.

3. The metal fabric according to claim 1, wherein coupling regions project out of the core fabric area on diametrically opposing sides.

4. The metal fabric according to claim 1, wherein at least one coupling region has a coupling area angularly offset to the core fabric area.

5. The metal fabric according to claim 1, wherein a coupling region has multiple coupling areas.

6. The metal fabric according to claim 1, wherein coupling areas of a coupling region directly adjoin one another at least partially.

7. The metal fabric according to claim 1, comprising coupling and decoupling areas, which communicate with one another in pairs, having an essentially equal angle to the fabric plane.

8. The metal fabric according to claim 1, comprising an at least essentially symmetrical arrangement of the optical waveguide element in relation to the fabric plane.

9. The metal fabric according to claim 1, wherein the optical waveguide element is colorless and preferably prismatic.

10. A metal fabric, wherein an optical waveguide element penetrates a core fabric area, said optical waveguide element comprising a plurality of discrete glass crystals provided in the fabric.

11. A metal fabric comprising an optical waveguide element structurally integrated into the fabric and penetrating a core fabric area, said optical waveguide element having a light coupling region and a light decoupling region, at least one of the coupling regions projecting outward out of the core fabric area.

12. The metal fabric according to claim 11, wherein the optical waveguide element is connected to a carrier and this carrier is integrated into the fabric.

13. The metal fabric according to claim 12, wherein separating the optical waveguide element from the carrier requires detaching the carrier from the fabric.

14. The metal fabric according to claim 12, wherein the carrier is attached to warp and/or weft using a clamp.

15. A method for manufacturing a metal fabric, wherein, after weaving, weft elements are removed from the metal fabric and optical waveguide elements are positioned in the region of the removed weft elements to penetrate a core fabric area, each of said optical waveguide elements having a light coupling region and a light decoupling region, at least one of the coupling regions projecting outward out of the core fabric area.

* * * * *